US007297672B2

(12) United States Patent
Cooper et al.

(10) Patent No.: US 7,297,672 B2
(45) Date of Patent: Nov. 20, 2007

(54) LAUNDRY TREATMENT COMPOSITIONS COMPRISING A β1-4 LINKED SUBSTITUTED POLYSACCHARIDE

(75) Inventors: James Bermard Cooper, Merseyside (GB); Robert Alan Hunter, Merseyside (GB); Giovanni Francesco Unali, Merseyside (GB)

(73) Assignee: Unilever Home & Personal Care USA Division of Conopco, Inc., Greenwich, CT (US)

( * ) Notice: Subject to any disclaimer, the term of this patent is extended or adjusted under 35 U.S.C. 154(b) by 264 days.

(21) Appl. No.: 10/726,823

(22) Filed: Dec. 3, 2003

(65) Prior Publication Data

US 2004/0138086 A1 Jul. 15, 2004

(30) Foreign Application Priority Data

Dec. 3, 2002 (GB) ..... 0228216.8
Dec. 23, 2002 (GB) ..... 0230026.7

(51) Int. Cl.
*C11D 3/22* (2006.01)
*C11D 9/36* (2006.01)

(52) U.S. Cl. ..... 510/417; 510/276; 510/432; 510/466; 510/470

(58) Field of Classification Search ..... 510/276, 510/417, 432, 466, 470
See application file for complete search history.

(56) References Cited

U.S. PATENT DOCUMENTS

| | | | | |
|---|---|---|---|---|
| 2,826,551 | A | 3/1958 | Geen | |
| 3,964,500 | A | 6/1976 | Drakoff | |
| 5,990,059 | A | 11/1999 | Finel et al. | |
| 6,903,208 | B2 * | 6/2005 | Findlay et al. | 536/55.1 |
| 6,939,842 | B2 * | 9/2005 | Hunter et al. | 510/470 |
| 7,012,053 | B1 * | 3/2006 | Barnabas et al. | 510/287 |
| 2002/0147128 | A1 * | 10/2002 | Trinh et al. | 510/515 |

FOREIGN PATENT DOCUMENTS

| | | | |
|---|---|---|---|
| EP | 0 459 821 B1 | | 12/1991 |
| EP | 0 459 822 B1 | | 12/1991 |
| EP | 0 495 176 B1 | | 7/1992 |
| WO | 99/21892 | | 5/1999 |
| WO | 00/18861 | * | 4/2000 |
| WO | 02/18528 | | 3/2002 |
| WO | 02/29152 A1 | | 4/2002 |
| WO | 03/020770 | | 3/2003 |
| WO | 03/020819 | | 3/2003 |
| WO | 03/028682 | | 4/2003 |

OTHER PUBLICATIONS

U.S. Appl. No. 10/726,740, filed Dec. 3, 2003, Carvell et al., Laundry Treatment Compositions and Components Therefor.
U.S. Appl. No. 10/225,863, filed Aug. 22, 2002, Findlay et al. (unpublished GB 0121148.1), Polymers and Their Use.
U.S. Appl. No. 10/225,864, filed Aug. 22, 2002, Hunter et al. (unpublished GB 0123380.8), Laundry Treatment Compositions.
International Search Report, PCT/EP03/13702, dated May 7, 2004.
GB Search Report 0230026.7, dated Jun. 24, 2003.

* cited by examiner

*Primary Examiner*—Charles Boyer
(74) *Attorney, Agent, or Firm*—Alan A. Bornstein

(57) ABSTRACT

A composition comprising a silicone having a viscosity modifying agent dissolved or dispersed therein and a deposition aid, wherein the deposition aid comprises a polymeric material comprising one or more moieties for enhancing affinity for a fabric, especially cotton or a cotton-containing fabric and one or more silicone moieties.

52 Claims, No Drawings

LAUNDRY TREATMENT COMPOSITIONS COMPRISING A β1-4 LINKED SUBSTITUTED POLYSACCHARIDE

TECHNICAL FIELD

The present invention relates to laundry treatment compositions for giving fabric softening and which also contain a viscosity modifying agent.

BACKGROUND OF THE INVENTION

Silicones of various structures are well known as ingredients of rinse conditioners to endow softness to fabrics.

U.S. 2002/0147128 discloses stable, aqueous fabric softening compositions which comprise selected polyalkyleneoxy polysiloxanes. The compositions may contain various further optional ingredients. These optional ingredients include perfumes and various selected fabric care polysaccharides.

U.S. Pat. No. 5,990,059 discloses a conditioning shampoo composition for hair and/or skin which comprises a stable microemulsion of a high viscosity, slightly cross-linked silicone with a particle size of <0.15 microns, in combination with a cationic deposition polymer and a surfactant. The cationic deposition polymer is preferably selected from the group consisting of cationic guar gum derivatives and cationic polyacrylamides.

WO 03/028682 discloses shampoo compositions having from about 5 to about 50 weight percent of a detersive surfactant, at least about 0.1 weight percent of non-platelet particles having a particle size of at least 0.1 micron, at least about 0.05 weight percent of a deposition aid, from 0 to about 2.5 weight percent silicone, and at least about 20 weight percent of an aqueous carrier. The deposition aid is preferably a cationic polymer.

Our UK patent application no. 0121148.1, unpublished at the priority date of this invention, describes and claims a substituted $\beta_{1-4}$ linked polysaccharide having covalently bonded on the polysaccharide moiety thereof, at least one deposition enhancing group which undergoes a chemical change in water at a use temperature to increase the affinity of the substituted polysaccharide to a substrate, the substituted polysaccharide further comprising one or more independently selected silicone chains. The polysaccharide acts as a vehicle to deposit the silicone chains bound to it, onto the fabric, from a wash liquor.

Our UK patent application no. 0123380.8, also unpublished at the priority date of this invention discloses that such substituted polysaccharides can be incorporated in compositions containing a silicone, per se to enhance deposition of the free silicone.

Further, our UK patent application no. 0228216.8, also unpublished at the priority date of this invention, discloses that perfume can be incorporated into the silicone component of compositions containing such polysaccharides and silicones, in order to enhance deposition of the perfume onto fabrics.

Many silicones that give beneficial fabric softening do not deposit well from detergent compositions because they are too viscous to from a suitable emulsion. This means that the benefit that would be derived from the efficient deposition of such viscous silicones cannot be harnessed from detergent compositions. Therefore, it is often the practice to use a silicone oil or mixture of silicone oils with a low viscosity, e.g. in the range of from 200 to 5,500 mPas. This makes the silicone easier to emulsify and deposit onto fabric. However, we have now found that by modifying the viscosity of viscous silicones that are conventionally too viscous to deposit well onto fabrics from detergent compositions, by the use of a viscosity modifying agent, surprisingly, the deposition of the viscous silicone onto fabrics is greatly improved from detergent compositions.

DEFINITION OF THE INVENTION

A first aspect of the present invention provides a laundry treatment composition comprising a silicone having a viscosity modifying agent dissolved or dispersed therein and a deposition aid, wherein the deposition aid comprises a polymeric material comprising one or more moieties for enhancing affinity for a fabric, especially cotton or a cotton-containing fabric and one or more silicone moieties.

A second aspect of the present invention provides a method for depositing a silicone onto a substrate, the method comprising, contacting in an aqueous medium, the substrate and a composition according to the first aspect of the invention.

A third aspect of the present invention provides a process for laundering fabrics by machine or hand, which includes the step of immersing the fabrics in a wash liquor comprising water in which a laundry treatment composition according to the first aspect of the invention is dissolved or dispersed.

A fourth aspect of the present invention provides a process according to the third aspect of the invention, wherein the fabrics comprise cotton fabrics.

A fifth aspect of the present invention provides a use of a laundry treatment composition according to the first aspect of the invention to enhance the softening benefit of a laundry treatment composition on a substrate.

DETAILED DESCRIPTION OF THE INVENTION

In the present invention, a viscosity modifying agent comprising one or more low viscosity components must be dispersed or dissolved in the silicone. Preferably, it is dissolved.

The Viscosity Modifying Agent

The viscosity modifying agent can be any suitable substance which can be mixed with the silicone such that the viscosity of the resulting silicone/viscosity modifying agent mixture is modified compared to that of the initial silicone. The viscosity modifying agent can be a viscosity lowering agent or a viscosity increasing agent. The viscosity modifying agent is preferably a viscosity lowering agent. The viscosity modifying agent is preferably intimately mixed with the silicone. It is further preferred that the viscosity modifying agent is uniformly mixed with the silicone. Preferably, the viscosity modifying agent is at least partially soluble in the silicone, more preferably it is substantially or fully soluble in the silicone.

The viscosity modifying agent is preferably selected from the group consisting of a volatile silicone, a perfume, an organic solvent and a low viscosity silicone, more preferably from the group consisting of volatile silicone and perfume, and most preferably, the viscosity modifying agent is a volatile silicone.

The viscosity modifying agent does not have to deliver a softening benefit.

Viscosity modifying agents according to the invention are particularly useful where a softening silicone has a viscosity above 5,000 mPas or above 5,500 mPas.

The amount of viscosity modifying agent is preferably from 5% to 40%, more preferably from 10% to 30% by weight of the silicone.

Suitable volatile silicones include dimethyl, methyl (aminoethylaminoisobutyl) siloxane, typically having a viscosity of from 100 mPas to 200 mPas with an average amine content of ca. 2 mol %. A specific example is DC245 ex Dow Corning.

Perfumes, especially those used in laundry treatment products, consist of at least one but usually a mixture of a plurality of fragrances of natural and/or synthetic origin dispersed, or more usually dissolved in a vehicle or carrier. The vehicle or carrier may be aqueous (i.e. water or water plus one or more water-miscible solvents) or it may consist solely of one or more organic solvents which may or may not be water-miscible, even though water is substantially absent. It is preferred for the vehicle or carrier to be dissolved or dispersed in the silicone.

Any suitable organic solvent may be used as a viscosity modifying agent in the present invention. Examples include isopropyl alcohol (IPA) and hexane.

Suitable low viscosity silicones include silicone oils or mixture of silicone oils with a low viscosity, eg in the range of from 200 to 5,500 mPas, for example from 200 to 5,000 mPas. A preferred example is Hydrosoft ex-Rhodia, an amino silicone.

Mixtures of the one or more types of viscosity modifying agents may be used.

The dissolved and/or dispersed viscosity modifying agent is preferably present in a weight ratio of from 1:10,000 to 1:5, preferably from 1:1,000 to 1:10 relative to the silicone.

Viscosity Modifying Agent Processing

The viscosity modifying agent may be admixed with all or part of the silicone prior to incorporation in the composition as a whole (whether that composition is a component of a laundry treatment composition per se). The step of admixture may be carried out in any suitable apparatus such as a high shear mixer. The amount of viscosity modifying agent is preferably incorporated in a weight ratio to the final silicone content of the composition of from 1:1,000 to 2:1, more preferably from 1:100 to 1:5, especially from 1:50 to 1:10.

The Silicone

As used herein reference to a silicone in which a viscosity modifying agent is dispersed or dissolved therein includes both a single liquid silicone compound or a mixture of two or more different liquid silicone compounds.

Silicones are conventionally incorporated in laundry treatment (e.g. wash or rinse) compositions to endow anti-foam, fabric softening, ease of ironing, anti-crease and other benefits. Any type of silicone can be used to impart the lubricating property of the present invention however, some silicones and mixtures of silicones are more preferred.

Typical inclusion levels are from 0.01% to 25%, preferably from 0.1% to 5% of silicone by weight of the total composition.

Suitable silicones include:

non-volatile silicone fluids, such as poly(di)alkyl siloxanes, especially polydimethyl siloxanes and carboxylated or ethoxylated varients. They may be branched, partially cross-linked or preferably linear.

aminosilicones, comprising any organosilicone having amine functionality for example as disclosed in EP-A-459 821, EP-A459 822 and WO 02/29152. They may be branched, partially cross-linked or preferably linear.

any organosilicone of formula H-SXC where SXC is any such group hereinafter defined, and derivatives thereof.

reactive silicones and phenyl silicones

The choice of molecular weight of the silicones is mainly determined by processability factors. However, the molecular weight of silicones is usually indicated by reference to the viscosity of the material. Preferably, the silicones are liquid and typically have a viscosity in the range 5,000 mPas to 300,000 mPas. Suitable silicones include and, for example, Rhodorsil Oil 21645, Rhodorsil Oil Extrasoft and Wacker Finish 1300. These viscosities are typically measured at 21 $s^{-1}$, as are other viscosities referred to herein, unless specifically indicated to the contrary.

More specifically, materials such as polyalkyl or polyaryl silicones with the following structure can be used:

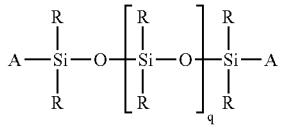

The alkyl or aryl groups substituted on the siloxane chain (R) or at the ends of the siloxane chains (A) can have any structure as long as the resulting silicones remain fluid at room temperature.

R preferably represents a phenyl, a hydroxy, an alkyl or an aryl group. The two R groups on the silicone atom can represent the same group or different groups. More preferably, the two R groups represent the same group preferably, a methyl, an ethyl, a propyl, a phenyl or a hydroxy group. "q" is preferably an integer from about 7 to about 8,000. "A" represents groups which block the ends of the silicone chains. Suitable A groups include hydrogen, methyl, methoxy, ethoxy, hydroxy, propoxy, and aryloxy.

Preferred alkylsiloxanes include polydimethyl siloxanes having a viscosity of greater than about 10,000 centistokes (cst) at 25° C.; and a most preferred silicone is a reactive silicone, i.e. where A is an OH group.

Suitable methods for preparing these silicone materials are disclosed in U.S. Pat. No. 2,826,551 and U.S. Pat. No. 3,964,500.

Other useful silicone materials include materials of the formula:

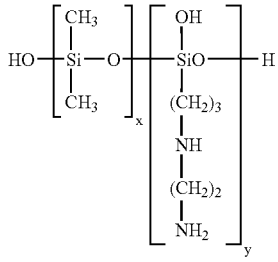

wherein x and y are integers which depend on the molecular weight of the silicone, the viscosity being from about 10,000 (cst) to about 500,000 (cst) at 25° C. This material is also known as "amodimethicone".

Other silicone materials which can be used, correspond to the formulae:

$$(R^1)_aG_{3-a}\text{-Si}—(—OSiG_2)_n—(OSiG_b(R^1)_{2-b})_m—O—SiG_{3-a}(R^1)_a$$

wherein G is selected from the group consisting of hydrogen, phenyl, OH, and/or $C_{1-8}$ alkyl; a denotes 0 or an integer from 1 to 3; b denotes 0 or 1; the sum of n+m is a number from 1 to about 2,000; $R^1$ is a monovalent radical of formula $CpH_2pL$ in which p is an integer from 2 to 8 and L is selected from the group consisting of $$—N(R^2)CH_2—CH_2—N(R^2)_2;$$

$$—N(R^2)_2;$$

$$—N^+(R^2)_3A^-; \text{ and}$$

$$—N^+(R^2)CH_2—CH_2N^+H_2A^-$$

wherein each $R^2$ is chosen from the group consisting of hydrogen, phenyl, benzyl, a saturated hydrocarbon radical, and each $A^-$ denotes a compatible anion, e.g. a halide ion; and

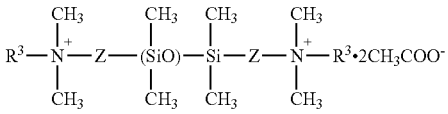

wherein

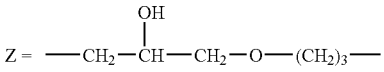

$R^3$ denotes a long chain alkyl group; and f denotes an integer of at least about 2.

Another silicone material which can be used, has the formula:

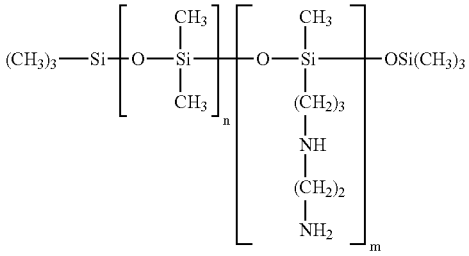

wherein n and m are the same as before.

Other suitable silicones comprise linear, cyclic, or three-dimensional polyorganosiloxanes of formula (I)

(I)

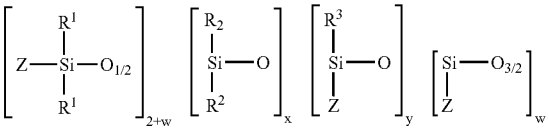

wherein (1) the symbols Z are identical or different, represent $R^1$, and/or V;

(2) $R^1$, $R^2$ and $R^3$ are identical or different and represent a monovalent hydrocarbon radical chosen from the linear or branched alkyl radicals having 1 to 4 carbon atoms, the linear or branched alkoxy radicals having 1 to 4 carbon atoms, a phenyl radical, preferably a hydroxy radical, an ethoxy radical, a methoxy radical or a methyl radical; and (3) the symbols V represent a group of sterically hindered piperidinyl functions chosen from (II)

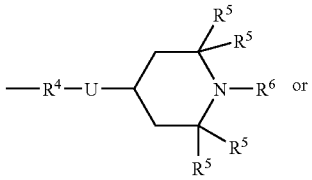

(III)

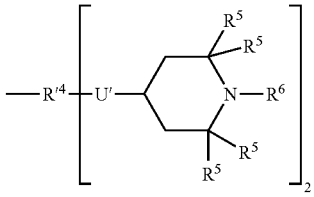

For the groups of formula II (II)

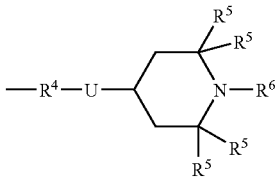

$R^4$ is a divalent hydrocarbon radical chosen from

- linear or branched alkylene radical, having 2 to 18 carbon atoms;
- linear or branched alkylene-carbonyl radical where the alkylene part is linear or branched, comprising 2 to 20 carbon atoms;
- linear or branched alkylene-cycolhexylene where the alkylene part is linear or branched, comprising 2 to 12 carbon atoms and the cyclohexylene comprises an OH group and possibly 1 or 2 alkyl radicals having 1 to 4 carbon atoms;
- the radicals of the formula $—R^7—O—R^7$ where the $R^7$ radical is identical or different represents an alkylene radical having 1 to 12 carbon atoms;
- the radicals of the formula $—R^7—O—R^7$ where the $R^7$ radical is as indicated previously and one or both are substituted by one or two OH groups;
- the radicals of the formula $—R^7—COO—R^7$ where the $—R^7$ radicals are as indicated previously;
- the radicals of formula $R^8—O—R^9—O—CO—R^8$ where the $R^8$ and $R^9$ radicals are identical or different, represent alkylene radicals and have 2 to 12 carbon atoms and the radical $R^9$ is possibly substituted with a hydroxyl radical;

U represents —O— or —$NR^{10}$—, $R^{10}$ is a radical chosen from a hydrogen atom, a linear or branched alkyl radical comprising 1 to 6 carbon atoms and a divalent radical of the formula:

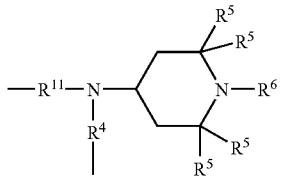

where $R^4$ is as indicated previously, $R^5$ and $R^6$ have the meaning indicated below et $R^{11}$ represents a divalent alkylene radical, linear or branched, having 1 to 12 carbon atoms, one of the valent bonds (one of $R^{11}$) is connected to an atom of —$NR^{10}$—, the other (one of $R^4$) is connected to a silicone atom;

the radical $R^5$ is identical or different, chosen from the linear or branched alkyl radicals having 1 to 3 carbon atoms and the phenyl radical;

the radical $R^6$ represents a hydrogen radical or the $R^5$ radical or O.

For the groups of formula (III):

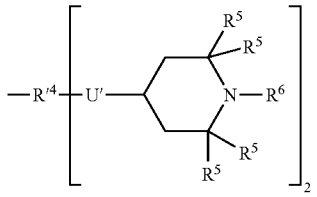

(III)

$R'^4$ is chosen from a trivalent radical of the formula:

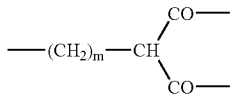

where m represents a number between 2 and 20, and a trivalent radical of the formula:

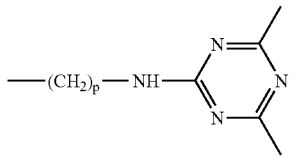

where p represents a number between 2 and 20;

U represents —O— or $NR^{12}$, $R^{12}$ is a radical chosen from a hydrogen atom, a linear or branched alkyl radical comprising 1 to 6 carbon atoms;

$R^5$ and $R^6$ have the same meaning as proposed for formula (II); and (4)—the number of units nSi without group V comprises between 10 and 450 the number of units nSi with group V comprises between 1 and 5, $0 \leqq w \leqq 10$ and $8 \leqq y \leqq 448$.

Compositions

The term "laundry treatment composition" is intended to refer to a composition as sold to, and used by the consumer e.g. in the wash or rinse. However, compositions of the invention may also constitute a component for a laundry treatment composition. A composition which is a component for a laundry treatment composition is one which is incorporated in the laundry treatment composition during manufacture of the latter.

Components for Laundry Treatment Compositions

Compositions consisting only of, or mainly of (e.g. up to 95% by weight of that composition) the silicone and dissolved or dispersed viscosity modifying agent, and optionally a suitable vehicle or carrier where the viscosity modifying agent is a perfume, may be incorporated in a laundry treatment composition. Generally these compositions also comprise a deposition aid for the silicone and the dissolved or dispersed viscosity modifying agent. Alternatively, or additionally, such a deposition aid may be separately incorporated in the laundry treatment composition.

A preferred deposition aid comprises a polymeric material comprising one or more moieties for enhancing affinity for a fabric, especially for cotton or a cotton-containing fabric and one or more silicone moieties.

One preferred class of deposition aids are substituted polysaccharides. These are described further hereinbelow.

Emulsions

The silicone with dispersed or dissolved viscosity modifying agent and deposition aid can be provided in the form of an emulsion for use in laundry treatment compositions.

One preferred emulsion according to the invention comprises a silicone comprising a dispersed or dissolved viscosity modifying agent and a substituted polysaccharide comprising $\beta_{1-4}$ linkages having covalently bonded on the polysaccharide moiety thereof, at least one deposition enhancing group which undergoes a chemical change in water at a use temperature to increase the affinity of the substituted polysaccharide to a substrate, the substituted polysaccharide further comprising one or more independently selected silicone chains.

The emulsion must contain another liquid component as well as the silicone with dispersed or dissolved silicone component, preferably a polar solvent, such as water. The emulsion has typically 30 to 99.9%, preferably 40 to 99% of the other liquid component (eg water). Low water emulsions may be for example 30 to 60% water, preferably 40 to 55% water. High water emulsions may be for example 60 to 99.9% water, preferably 80 to 99% water. Moderate water emulsions may be for example 55 to 80% water.

The emulsion may contain an emulsifying agent, preferably an emulsifying surfactant for the silicone with dispersed or dissolved viscosity modifying agent and polysaccharide. The emulsifying agent is especially one or more surfactants, for example, selected from any class, sub class or specific surfactant(s) disclosed herein in any context. The emulsifying agent most preferably comprises or consists of a non-ionic surfactant. Additionally or alternatively, one or more selected additional surfactants from anionic, cationic, zwitterionic and amphoteric surfactants may be incorporated in or used as the emulsifiying agent.

Suitable non-ionic surfactants include the (poly)alkoxylated analogues of saturated or unsaturated fatty alcohols, for example, having from 8 to 22, preferably from 9 to 18, more preferably from 10 to 15 carbon atoms on average in the hydrocarbon chain thereof and preferably on average from 3 to 11, more preferably from 4 to 9 alkyleneoxy groups. Most preferably, the alkyleneoxy groups are independently selected from ethyleneoxy, propyleneoxy and butylenoxy, especially ethyleneoxy and propylenoxy, or solely ethyleneoxy groups and alkyl polyglucosides as disclosed in EP 0 495 176.

Preferably, the (poly)alkoxylated analogues of saturated or unsaturated fatty alcohols, have a hydrophilic-lipophilic balance (HLB) of between 8 to 18. The HLB of a polyethoxylated primary alcohol nonionic surfactant can be calculated by $$HLB = \frac{MW(EO)}{MW(TOT) \times 5} \times 100$$

where

MW (EO)=the molecular weight of the hydrophilic part (based on the average number of EO groups)

MW(TOT)=the molecular weight of the whole surfactant (based on the average chain length of the hydrocarbon chain)

This is the classical HLB calculation according to Griffin (J. Soc. Cosmentic Chemists, 5 (1954) 249-256).

For analogous nonionics with a mix of ethyleneoxy (EO), propylenoxy (PO) and/or butyleneoxy (BO) hydrophilic groups, the following formula can be used;

$$HLB = \frac{MW(EO) + 0.57\ MW(PO) + 0.4\ MW(BO)}{MW(TOT) \times 5}$$

Preferably, the alkyl polyglucosides may have the following formula;

$$R\text{—}O\text{-}Z_n$$

in which R is a linear or branched, saturated or unsaturated aliphatic alkyl radical having 8 to 18 carbon atoms or mixtures thereof, and $Z_n$ is a polyglycosyl radical with n=1.0 to 1.4 hexose or pentose units or mixtures. Preferred examples of alkylpolyglucosides include Glucopon™.

Whether in a composition of a component (especially an emulsion) to be incorporated in a laundry treatment composition or in a laundry treatment composition as a whole, the weight ratio of silicone to the deposition aid is preferably from 1:1 to 100:1, more preferably from 5:1 to 20:1. The weight ratio of deposition aid to emulsifying agent is from 1:2 to 100:1, preferably 2:1 to 10:1. Further, in any such composition (especially emulsion components) the weight ratio of silicone with dissolved or dispersed viscosity modifying agent to emulsifying agent is from 100:1 to 2:1, preferably from 100:3 to 5:1, more preferably from 15:1 to 7:1.

Preferably, the total amount of silicone with dissolved or dispersed viscosity modifying agent is from 50 to 95%, preferably from 60 to 90%, more preferably from 70 to 85% by weight of the silicone with dissolved or dispersed viscosity modifying agent plus deposition aid plus any emulsifying agent.

Emulsion Processing

When in the form of an emulsion, the emulsion is prepared by mixing the silicone with dissolved or dispersed viscosity modifying agent deposition aid, other liquid component, e.g. water and preferably, also an emulsifying agent, such as a surfactant, especially a non-ionic surfactant, e.g. in a high shear mixer.

Whether or not pre-emulsified, the silicone with dissolved or dispersed viscosity modifying agent and the deposition aid may be incorporated by admixture with other components of a laundry treatment composition. Preferably, the emulsion is present at a level of from 0.0001 to 40%, more preferably from 0.001 to 30%, even more preferably from 0.1 to 20%, especially from 1 to 15% and for example from 5 to 10% by weight of the total composition.

When the silicone with dissolved or dispersed viscosity modifying agent is to be incorporated in an emulsion such as hereinbefore described, the admixture of viscosity are all or part of the silicone is preferably carried out as a processing step before, especially immediately before formation of the emulsion.

Substituted Polysaccharides

A preferred deposition aid, whether a laundry treatment composition or a component therefore, is a substituted polysaccharide.

The substituted polysaccharide is preferably water-soluble or water-dispersible in nature and comprises a polysaccharide substituted with at least one silicone moiety attached to the polysaccharide aid by a hydrolytically stable bond.

In such a substituted polysaccharide, the silicone chain is preferably attached to the polysaccharide by a covalent stable bond. That means that the bonding of the silicone should be sufficiently stable so as not to undergo hydrolysis in the environment of the treatment process for the duration of that process. For example, in laundry cleaning applications, the substituted polysaccharide should be sufficiently stable so that the bond between the silicone and polysaccharide does not undergo hydrolysis in the wash liquor, at the wash temperature, before the silicone has been deposited onto the fabric.

Preferably, the bond between the silicone and the polysaccharide is such that the decay rate constant ($k_d$) of the material in an aqueous solution at 0.01 wt % of the material together with 0.1 wt % of anionic surfactant at a temperature of 40° C. at a pH of 10.5 is such that $k_d < 10^{-3} s^{-1}$.

By water-soluble, as used herein, what is meant is that the material forms an isotropic solution on addition to water or another aqueous solution.

By water-dispersible, as used herein, what is meant is that the material forms a finely divided suspension on addition to water or another aqueous solution.

By an increase in the affinity of the substituted polysaccharide for a substrate such as a textile fabric upon a chemical change, what is meant is that at some time during the treatment process, the amount of material that has been deposited is greater when the chemical change is occurring or has occurred, compared to when the chemical change has not occurred and is not occurring, or is occurring more slowly, the comparison being made with all conditions being equal except for that change in the conditions which is necessary to affect the rate of chemical change.

Deposition onto a substrate includes deposition by adsorption, co-crystallisation, entrapment and/or adhesion.

The Polysaccharide Part

The polysaccharide is preferably $\beta_{1-4}$ linked and is a cellulose, a cellulose derivative, or another $\beta$-$_{1,4}$-linked polysaccharide having an affinity for cellulose, such as mannan and glucomannan.

Preferably, the polysaccharide has only $\beta_{1-4}$ linkages. Optionally, the polysaccharide has linkages in addition to the $\beta_{1-4}$ linkages, such as $\beta_{1-3}$ linkages. Thus, optionally some other linkages are present. Polysaccharide backbones which include some material which is not a saccharide ring are also within the ambit of the present invention (whether terminal or within the polysaccharide chain).

The polysaccharide may be straight or branched. Many naturally occurring polysaccharides have at least some degree of branching, or at any rate at least some saccharide rings are in the form of pendant side groups (which are therefore not in themselves counted in determining the degree of substitution) on a main polysaccharide backbone.

A polysaccharide comprises a plurality of saccharide rings which have pendant hydroxyl groups. In the substituted polysaccharides of the present invention, at least some of these hydroxyl groups are independently substituted by, or replaced with, one or more other substituents, at least one being a silicone chain. The "average degree of substitution" for a given class of substituent means the average number of substituents of that class per saccharide ring for the totality of polysaccharide molecules in the sample and is determined for all saccharide rings.

The Deposition Enhancing Group(s)

A deposition enhancing group is a group which undergoes a chemical change in use, and is attached to the polysaccharide agent group by means of a covalent stable bond. This chemical change results in an increase of the affinity of the material for the substrate and is referred to further below.

The chemical change which causes the increased substrate affinity is preferably caused by hydrolysis, perhydrolysis or bond-cleavage, optionally catalysed by an enzyme or another catalyst. Hydrolysis of substituent ester-linked groups is typical.

By ester linkage is meant that the hydrogen of an —OH group has been replaced by a substituent such as R'—CO—, R'$SO_2$— etc to form a carboxylic acid ester, sulphonic acid ester (as appropriate) etc together with the remnant oxygen attached to the saccharide ring. In some cases, the group R' may for example contain a heteroatom, e.g. as an —NH— group attached to the carbonyl, sulphonyl etc group, so that the linkage as a whole could be regarded as a urethane etc linkage. However, the term ester linkage is still to be construed as encompassing these structures.

The average degree of substitution of these pendant groups which undergo the chemical change is preferably from 0.1 to 3 (e.g. from 0.3 to 3), more preferably from 0.1 to 1 (e.g. from 0.3 to 1)

The Silicone Chain(s)

As used herein the term "silicone chain" means a polysiloxane or derivative thereof. In the section "Preferred Overall Structure" hereinbelow, various preferred silicone chains are recited and these are typically suitable, whether or not the substituted polysaccharide conforms to the preferred overall structure, Preferred Overall Structures Preferred substituted polysaccharides of the invention are cellulosic polymers of formula (I):

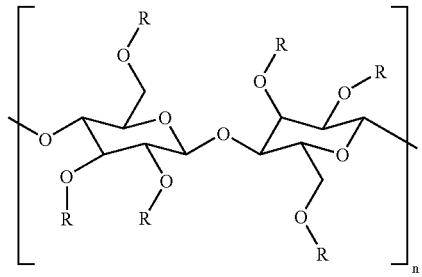

(I)

(optional $\beta_{1-3}$ and/or other linkages and/or other groups being permitted in the above formula (I)) wherein at least one or more —OR groups of the polymer are substituted by or replaced by independently selected silicone chains and at least one or more R groups are independently selected from groups of formulae:

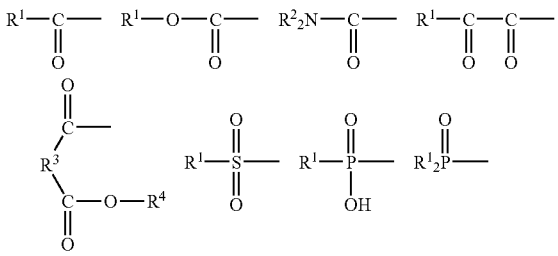

wherein each $R^1$ is independently selected from $C_{1-20}$ (preferably $C_{1-6}$) alkyl, $C_{2-20}$ (preferably $C_{2-6}$) alkenyl (e.g. vinyl) and $C_{5-7}$ aryl (e.g. phenyl) any of which is optionally substituted by one or more substituents independently selected from $C_{1-4}$ alkyl, $C_{1-12}$ (preferably $C_{1-4}$) alkoxy, hydroxyl, vinyl and phenyl groups;

each $R^2$ is independently selected from hydrogen and groups $R^1$ as hereinbefore defined;

$R^3$ is a bond or is selected from $C_{1-4}$ alkylene, $C_{2-4}$ alkenylene and $C_{5-7}$ arylene (e.g. phenylene) groups, the carbon atoms in any of these being optionally substituted by one or more substituents independently selected from $C_{1-12}$ (preferably $C_{1-4}$) alkoxy, vinyl, hydroxyl, halo and amine groups;

each $R^4$ is independently selected from hydrogen, counter cations such as alkali metal (preferably Na) or $$\frac{1}{2}\,Ca$$

Ca or $$\frac{1}{2}\,Mg,$$

Mg, and groups $R^1$ as hereinbefore defined; and groups R which together with the oxygen atom forming the linkage to the respective saccharide ring forms an ester or hemi-ester group of a tricarboxylic- or higher polycarboxylic- or other complex acid such as citric acid, an amino acid, a synthetic amino acid analogue or a protein;

any remaining R groups being selected from hydrogen and other substituents.

For the avoidance of doubt, as already mentioned, in formula (I), some of the R groups may optionally have one or more structures, for example as hereinbefore described. For example, one or more R groups may simply be hydrogen or an alkyl group.

Preferred groups which undergo the chemical change may for example be independently selected from one or more of acetate, propanoate, trifluroacetate, 2-(2-hydroxy-1-oxopropoxy) propanoate, lactate, glycolate, pyruvate, crotonate, isovalerate cinnamate, formate, salicylate, carbamate, methylcarbamate, benzoate, gluconate, methanesulphonate, toluene, sulphonate, groups and hemiester groups of fumaric, malonic, itaconic, oxalic, maleic, succinic, tartaric, aspartic, glutamic, and malic acids.

Particularly preferred such groups are the monoacetate, hemisuccinate, and 2-(2-hydroxy-1-oxopropoxy)propanoate. The term "monoacetate" is used herein to denote those acetates with the degree of substitution of 1 or less on a cellulose or other β-1,4 polysaccharide backbone.

Cellulose esters of hydroxyacids can be obtained using the acid anhydride in acetic acid solution at 20-30° C. and in any case below 50° C. When the product has dissolved the liquid is poured into water (b.p. 316,160). Tri-esters can be converted to secondary products as with the triacetate. Glycollic and lactic ester are most common.

Cellulose glycollate may also be obtained from cellulose chloracetate (GB-A-320 842) by treating 100 parts with 32 parts of NaOH in alcohol added in small portions.

An alternative method of preparing cellulose esters consists in the partial displacement of the acid radical in a cellulose ester by treatment with another acid of higher ionisation constant (FR-A-702 116). The ester is heated at about 100° C. with the acid which, preferably, should be a solvent for the ester. By this means cellulose acetate-oxalate, tartrate, maleate, pyruvate, salicylate and phenylglycollate have been obtained, and from cellulose tribenzoate a cellulose benzoate-pyruvate. A cellulose acetate-lactate or acetate-glycollate could be made in this way also. As an example cellulose acetate (10 g.) in dioxan (75 ml.) containing oxalic acid (10 g.) is heated at 100° C. for 2 hours under reflux.

Multiple esters are prepared by variations of this process. A simple ester of cellulose, e.g. the acetate, is dissolved in a mixture of two (or three) organic acids, each of which has an ionisation constant greater than that of acetic acid ($1.82\times 10^{-5}$). With solid acids suitable solvents such as propionic acid, dioxan and ethylene dichloride are used. If a mixed cellulose ester is treated with an acid this should have an ionisation constant greater than that of either of the acids already in combination.

A cellulose acetate-lactate-pyruvate is prepared from cellulose acetate, 40 percent. acetyl (100 g.), in a bath of 125 ml. pyruvic acid and 125 ml. of 85 percent. lactic acid by heating at 100° C. for 18 hours. The product is soluble in water and is precipitated and washed with ether-acetone. M.p. 230-250° C.

In the case of those materials having a cellulose backbone and pendant ester groups, without being bound by any particular theory or explanation, the inventors have conjectured that the mechanism of deposition is as follows.

Cellulose is substantially insoluble in water. Attachment of the ester groups to make a cellulose derivative causes disruption of the hydrogen bonding between rings of the cellulose chain or chains, thus increasing water solubility or dispersibility. In the treatment liquor, the ester groups are hydrolysed, causing the cellulose derivative to increase its affinity for the substrate, e.g. the fabric.

In the case when solubilising groups are attached to the polysaccharide, this is typically via covalent bonding and, may be pendant upon the backbone or incorporated therein. The type of solubilising group may alter according to where the group is positioned with respect to the backbone.

In this specification the "n" subscript used in the general formulae of the substituted polysaccharide is a generic reference to a polymer. Although "n" can also mean the actual (average) number of repeat units present in the polysaccharide, it is more meaningful to refer to "n" by the number average molecular weight.

The number average molecular weight ($M_n$) of the substituted polysaccharide part may typically be in the range of 1,000 to 200,000, for example 2,000 to 100,000, e.g. as measured using GPC with multiple angle laser scattering detection.

The silicone chains preferred for use to substitute or replace (dependent upon the synthetic route use to prepare the substituted polysaccharides of the invention) at least one —OR group in the compounds of formula (I) are representative of preferred silicone chains for use in substituted polysaccharides used in the invention as a whole, i.e. whether or not the overall structure conforms to formula (I).

Preferably, the average degree of substitution for the silicone chains is from 0.001 to 0.5, preferably from 0.01 to 0.5, more preferably from 0.01 to 0.1, still more preferably from 0.01 to 0.05.

Even more preferably the average degree of substitution for the silicone chains is from 0.00001 to 0.1, more preferably from 0.001 to 0.04, even more preferably from 0.001 to 0.01.

Preferred silicone chains suitable for this use are those of formula:

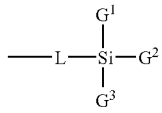

wherein L is absent or is a linking group and one or two of substituents $G^1$-$G^3$ is a methyl group, the remainder being selected from groups of formula

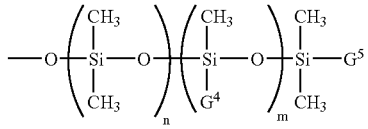

the $—Si(CH_3)_2O—$ groups and the $—Si(CH_30)(G^4)—$ groups being arranged in random or block fashion, but preferably random.

wherein n is from 5 to 1000, preferably from 10 to 200 and m is from 0 to 100, preferably from 0 to 20, for example from 1 to 20.

$G^4$ is selected from groups of formula:

$—(CH_2)_p—CH_3$, where p is from 1 to 18

$—(CH_2)_q—NH—(CH_2)_r—NH_2$ where q and r are independently from 1 to 3

$—(CH_2)_s—NH_2$, where s is from 1 to 3

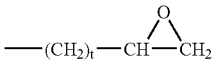

where t is from 1 to 3

$—(CH_2)_u—COOH$, where u is from 1 to 10,

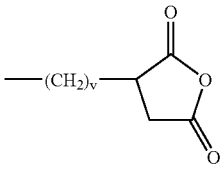

where v is from 1 to 10, and $—(CH_2CH_2O)_w—(CH_2)_xH$, where w is from 1 to 150, preferably from 10 to 20 and x is from 0 to 10;

and $G^5$ is independently selected from hydrogen, groups defined above for $G^4$, —OH, $—CH_3$ and $—C(CH_3)_3$.

Other Substituents

As well as the silicone chain(s) and the pendant group(s) which undergo a chemical change to enhance deposition, pendant groups of other types may optionally be present, i.e. groups which do not confer a benefit and which do not undergo a chemical change to enhance substrate affinity. Within that class of other groups is the sub-class of groups for enhancing the solubility of the material (e.g. groups which are, or contain one or more free carboxylic acid/salt and/or sulphonic acid/salt and/or sulphate groups).

Examples of solubility enhancing substituents include carboxyl, sulphonyl, hydroxyl, (poly)ethyleneoxy- and/or (poly)propyleneoxy-containing groups, as well as amine groups.

The other pendant groups preferably comprise from 0% to 65%, more preferably from 0% to 10% of the total number of pendant groups. The water-solubilising groups could comprise from 0% to 100% of those other groups but preferably from 0% to 20%, more preferably from 0% to 10%, still more preferably from 0% to 5% of the total number of other pendant groups.

Synthetic Routes

As described above, preferred substituted polysaccharides of the present invention are those of formula (I). Further, preferred silicone chains, whether for the compounds of formula (I) or any other substituted polysaccharides of the invention are preferably attached via a linking group "-L-". This linking group is the residue of the reactants used to form the substituted polysaccharide.

The substituted polysaccharides of the invention can be made thus:

(a) a polysaccharide is first substituted with one or more deposition enhancing groups; and (b) one or more silicone groups are then attached.

If any other substituents are to be present, these may already be present in the commercially available polysaccharide, or attached before or after step (a) and/or (b).

Whilst steps (a) and (b) can be reversed, the reaction whereby step (a) is conducted first is preferred.

The deposition enhancing group(s) is/or are attached in step (a) according to the methodology described in WO-A-00/18861.

In step (b), one or more hydroxyl groups on the polysaccharide are reacted with a reactive group attached to the silicone chain, or the hydroxyl group(s) in question is/are converted to another group capable of reaction with a reactive group attached to the silicone chain. Listed below, are suitable mutually reactive groups. In the case of hydroxyl groups, these may be the original hydroxyl group of the polysaccharide. However, either of a pair of these mutually reactive groups may be present on the polysaccharide and the other attached to the silicone chain, or vice versa, the reaction chemistry being chosen appropriately. In the following description, for convenience, "PSC" refers to the polysaccharide chain with or without deposition enhancing group(s) and/or other substituent(s) already attached. "SXC" refers to the group

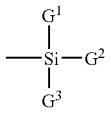

as hereinbefore defined.

Preferred linking groups -L- are selected from the following, wherein preferably, the left hand end of the group depicted is connected to the saccharide ring either direct or via the residual oxygen of one of the original saccharide —OH groups and the right hand end is connected to the moiety $—Si(G^1G^2G^3)$. Thus, the configuration as written is PSC-L-SXC. However, the reverse configuration SXC-L-PSC is also within the ambit of this definition and this is also mentioned where appropriate.

Preferred linking groups -L- are selected from amide, ester, ether, urethane, triazine, carbonate, amine and ester-alkylene linkages.

A preferred amide linkage is:

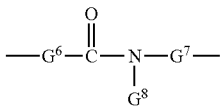

where $G^6$ and $G^7$ are each optionally present and are independently selected spacer groups, e.g. selected from $C_{1-14}$ alkylene groups, arylene, $C_{1-4}$ alkoxylene, a residue of an oligo- or poly-ethylene oxide moiety, $C_{1-4}$ alkylamine or a polyamine groups and $G^8$ is hydrogen or $C_{1-4}$ alkyl.

This linkage can be formed by reacting

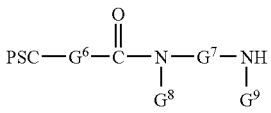

wherein $G^7$ and $G^8$ are as hereinbefore defined and $G^9$ is hydrogen or $C_{1-4}$ alkyl;

with a compound of formula:

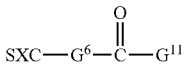

wherein $G^{11}$ is hydroxy, a group with active ester functionality halo, or a leaving group suitable for neucleophilie displacement such as imidazole or an imidazole-containing group and wherein $G^6$ is hereinbefore defined above, or —CO-$G^{11}$ is replaced by a cyclic acid anhydride. Active ester synthesis is described in M. Bodanszky, "The Peptides", Vol. 1, Academic Press Inc., 1975, pp 105 ff.

The reverse configuration linkage may be formed by reacting

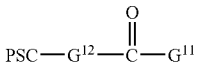

wherein $G^{12}$ is a ring-opened carboxylic acid anhydride, phenylene, or a group of formula

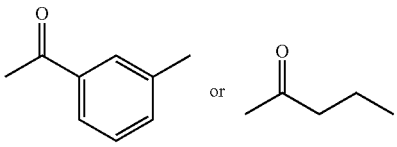

and $G^{11}$ is as hereinbefore defined;

with the group of formula

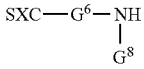

where $G^6$ and $G^8$ are as hereinbefore defined.

A preferred ester linkage has the formula

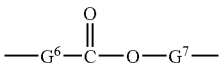

wherein $G^6$ and $G^7$ are as hereinbefore defined, $G^6$ optionally being absent.

This may be formed by reacting

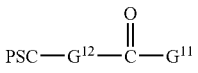

wherein $G^{11}$ and $G^{12}$ are as hereinbefore defined with

SXC-$G^6$-OH wherein $G^6$ is as hereinbefore defined.

The reverse ester linkage formation may be formed by reacting

PSC-$G^7$-OH (i.e. the optionally modified polysaccharide with at least one residual —OH group)

with

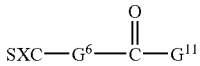

wherein $G^6$ and $G^{11}$ are as hereinbefore defined, or —CO-$G^{11}$ may be replaced by a cyclic anhydride.

Preferred ether linkages have the formula

-$G^6$-O-$G^7$- wherein $G^6$ and $G^7$ are as hereinbefore defined, optionally one being absent.

This linkage may be formed by reacting

PSC-$G^6$-OH with

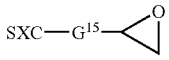

wherein $G^{15}$ is $C_{1-4}$ alkylene and $G^6$ is optionally absent and is as hereinbefore defined.

A preferred urethane linkage is

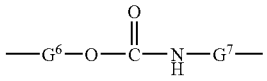

wherein $G^6$ and $G^7$ are as hereinbefore defined, $G^6$ optionally being absent (preferably absent in the configuration PSC-L-SXC)

PSC-$G^6$-OH with

SXC-$G^7$NCO wherein $G^6$ and $G^7$ are as hereinbefore defined, $G^6$ optionally being absent (preferably absent in the configuration PSC-L-SXC)

The reverse configuration is also possible but the simplest arrangement is PSC-L-SXC and wherein $G^6$ is absent. Also most common is when $G^7$ is alkylene.

The latter compound is made by reacting

SXC-$G^7$-$NH_2$ wherein $G^7$ is as hereinbefore defined;

with phosgene.

Another route is to react

PSC-$G^6$-OH wherein $G^6$ is as hereinbefore defined with carbonyl dimidazole to form

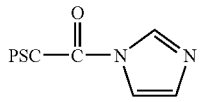

and react that product with

SXC-$G^7$-$NH_2$ wherein $G^7$ is as hereinbefore defined.

Preferred triazine linkages have the formula

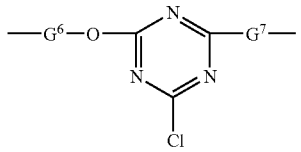

wherein $G^6$ and $G^7$ are as hereinbefore defined, $G^6$ optionally being absent.

These linkages may be formed by reacting

SXC-$G^7$-OH or

SXC-$G^7$-$NH_2$ wherein $G^7$ is as hereinbefore defined with cyanuic chloride and then with

PSC-$G^6$-OH wherein $G^6$ is as hereinbefore defined but may be absent;

or (reverse -L-) by reacting

PSC-$G^7$-OH with cyanuric chloride (when $G^7$ is as hereinbefore defined) and then with

SXC-$G^6$-OH or

SXC-$G^6$-$NH_2$

Preferred carbonate linkages have the formula

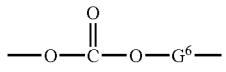

wherein $G^6$ is as hereinbefore defined.

This linkage may be formed by reacting

PSC-OH with

SXC-$G^6$-OH in the presence of carbonyl dimidazole or phosgene

Preferred amine linkages have the formula

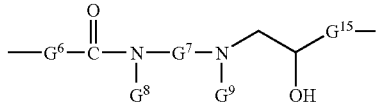

wherein $G^6$, $G^7$, $G^8$, $G^9$ and $G^{15}$ are as hereinbefore defined.

This linkage may be formed by reacting

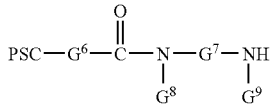

wherein $G^6$-$G^9$ are hereinbefore defined;

with

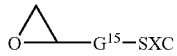

wherein $G^{15}$ is as hereinbefore defined.

Preferred ester-alkylene linkages have the formula

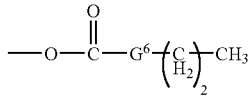

wherein $G^7$ is as hereinbefore defined.

These linkages may be prepared by reacting

PSC-OH with

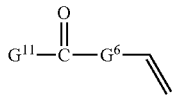

and then reacting with a hydrogen-terminated silicone chain compound (i.e. $G^5$=H) over a platinum catalyst.

Laundry Treatment Compositions

The silicone with dissolved or dispersed viscosity modifying agent and deposition aid, are incorporated together into laundry compositions, as separate ingredients or a composition which is an ingredient to be incorporated in the laundry treatment composition, especially as an emulsion. For example, such a composition may optionally also comprise only a diluent (which may comprise solid and/or liquid) and/or also it may comprise an active ingredient. The deposition aid is typically included in said compositions at levels of from 0.001% to 10% by weight, preferably from 0.005% to 5%, most preferably from 0.01% to 3%.

If the component is in the form of an emulsion, typical inclusion levels of the emulsion in the laundry treatment composition are from 0.0001 to 40%, more preferably from 0.001 to 30%, even more preferably from 0.1 to 20%, especially from 1 to 15% and for example from 5 to 10% by weight of the total composition.

Laundry Treatment Compositions

The active ingredient in the compositions is preferably a surface active agent or a fabric conditioning agent. More than one active ingredient may be included. For some applications a mixture of active ingredients may be used.

The compositions of the invention may be in any physical form e.g. a solid such as a powder or granules, a tablet, a solid bar, a paste, gel or liquid, especially, an aqueous based liquid. In particular the compositions may be used in laundry compositions, especially in liquid, powder or tablet laundry composition.

The compositions of the present invention are preferably laundry compositions, especially main wash (fabric washing) compositions or rinse-added softening compositions. The main wash compositions may include a fabric softening agent and rinse-added fabric softening compositions may include surface-active compounds, particularly non-ionic surface-active compounds, if appropriate.

Detergent compositions of the invention may suitably comprise:

(a) from 5 to 60 wt %, preferably from 10 to 40 wt %, of organic surfactant, (b) optionally from 5 to 80 wt %, preferably from 10 to 60 w %, of detergency builder, (c) optionally other detergent ingredients to 100 wt %.

The detergent compositions of the invention may contain a surface-active compound (surfactant) which may be chosen from soap and non-soap anionic, cationic, non-ionic, amphoteric and zwitterionic surface-active compounds and mixtures thereof. Many suitable surface-active compounds are available and are fully described in the literature, for example, in "Surface-Active Agents and Detergents", Volumes I and II, by Schwartz, Perry and Berch.

The preferred detergent-active compounds that can be used are soaps and synthetic non-soap anionic and non-ionic compounds.

The compositions of the invention may contain linear alkylbenzene sulphonate, particularly linear alkylbenzene sulphonates having an alkyl chain length of $C_8$-$C_{15}$. It is preferred if the level of linear alkylbenzene sulphonate is from 0 wt % to 30 wt %, more preferably 1 wt % to 25 wt %, most preferably from 2 wt % to 15 wt %.

The compositions of the invention may contain other anionic surfactants in amounts additional to the percentages quoted above. Suitable anionic surfactants are well-known to those skilled in the art. Examples include primary and secondary alkyl sulphates, particularly $C_8$-$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

The compositions of the invention may also contain non-ionic surfactant. Nonionic surfactants that may be used include the primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

It is preferred if the level of non-ionic surfactant is from 0 wt % to 30 wt %, preferably from 1 wt % to 25 wt %, most preferably from 2 wt % to 15 wt %.

Any conventional fabric conditioning agent may be used in the compositions of the present invention. The conditioning agents may be cationic or non-ionic. If the fabric conditioning compound is to be employed in a main wash detergent composition the compound will typically be non-ionic. For use in the rinse phase, typically they will be cationic. They may for example be used in amounts from 0.5% to 35%, preferably from 1% to 30% more preferably from 3% to 25% by weight of the composition.

Suitable cationic fabric softening compounds are substantially water-insoluble quaternary ammonium materials comprising a single alkyl or alkenyl long chain having an average chain length greater than or equal to $C_{20}$ or, more preferably, compounds comprising a polar head group and two alkyl or alkenyl chains having an average chain length greater than or equal to $C_{14}$. Preferably the fabric softening compounds have two long chain alkyl or alkenyl chains each having an average chain length greater than or equal to $C_{16}$. Most preferably at least 50% of the long chain alkyl or alkenyl groups have a chain length of $C_{18}$ or above. It is preferred if the long chain alkyl or alkenyl groups of the fabric softening compound are predominantly linear.

Quaternary ammonium compounds having two long-chain aliphatic groups, for example, distearyldimethyl ammonium chloride and di(hardened tallow alkyl) dimethyl ammonium chloride, are widely used in commercially available rinse conditioner compositions. Other examples of these cationic compounds are to be found in "Surfactants Science Series" volume 34 ed. Richmond 1990, volume 37 ed. Rubingh 1991 and volume 53 eds. Cross and Singer 1994, Marcel Dekker Inc. New York".

Any of the conventional types of such compounds may be used in the compositions of the present invention.

The fabric softening compounds are preferably compounds that provide excellent softening, and are characterised by a chain melting $L_\beta$ to $L_\alpha$ transition temperature greater than 25° C., preferably greater than 35° C., most preferably greater than 45° C. This $L_\beta$ to $L_\alpha$ transition can be measured by differential scanning calorimetry as defined in "Handbook of Lipid Bilayers", D Marsh, CRC Press, Boca Raton, Fla., 1990 (pages 137 and 337).

Substantially water-insoluble fabric softening compounds are defined as fabric softening compounds having a solubility of less than $1\times10^{-3}$ wt % in demineralised water at 20° C. Preferably the fabric softening compounds have a solubility of less than $1\times10^{-4}$ wt %, more preferably less than $1\times10^{-8}$ to $1\times10^{-6}$ wt %.

Especially preferred are cationic fabric softening compounds that are water-insoluble quaternary ammonium materials having two $C_{12-22}$ alkyl or alkenyl groups connected to the molecule via at least one ester link, preferably two ester links. An especially preferred ester-linked quaternary ammonium material can be represented by the formula:

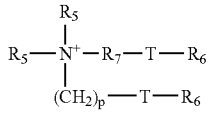

wherein each $R_5$ group is independently selected from $C_{1-4}$ alkyl or hydroxyalkyl groups or $C_{2-4}$ alkenyl groups; each $R_6$ group is independently selected from $C_{8-28}$ alkyl or alkenyl groups; and wherein $R_7$ is a linear or branched alkylene group of 1 to 5 carbon atoms, T is

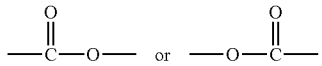

and p is 0 or is an integer from 1 to 5.

Di(tallowoxyloxyethyl) dimethyl ammonium chloride and/or its hardened tallow analogue is an especially preferred compound of this formula.

A second preferred type of quaternary ammonium material can be represented by the formula:

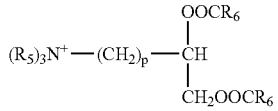

wherein $R_5$, p and $R_6$ are as defined above.

A third preferred type of quaternary ammonium material are those derived from triethanolamine (hereinafter referred to as 'TEA quats') as described in for example U.S. Pat. No. 3,915,867 and represented by formula:

$$(TOCH_2CH_2)_3N+(R_9)$$

wherein T is H or ($R_8$—CO—) where $R_8$ group is independently selected from $C_{8-28}$ alkyl or alkenyl groups and $R_9$ is $C_{1-4}$ alkyl or hydroxyalkyl groups or $C_{2-4}$ alkenyl groups. For example N-methyl-N,N,N-triethanolamine ditallowester or di-hardened-tallowester quaternary ammonium chloride or methosulphate. Examples of commercially available TEA quats include Rewoquat WE18 and Rewoquat WE20, both partially unsaturated (ex. WITCO), Tetranyl AOT-1, fully saturated (ex. KAO) and Stepantex VP 85, fully saturated (ex. Stepan).

It is advantageous if the quaternary ammonium material is biologically biodegradable.

Preferred materials of this class such as 1,2-bis(hardened tallowoyloxy)-3-trimethylammonium propane chloride and their methods of preparation are, for example, described in U.S. Pat. No. 4,137,180 (Lever Brothers Co). Preferably these materials comprise small amounts of the corresponding monoester as described in U.S. Pat. No. 4,137,180, for example, 1-hardened tallowoyloxy-2-hydroxy-3-trimethylammonium propane chloride.

Other useful cationic softening agents are alkyl pyridinium salts and substituted imidazoline species. Also useful are primary, secondary and tertiary amines and the condensation products of fatty acids with alkylpolyamines.

The compositions may alternatively or additionally contain water-soluble cationic fabric softeners, as described in GB 2 039 556B (Unilever).

The compositions may comprise a cationic fabric softening compound and an oil, for example as disclosed in EP-A-0829531.

The compositions may alternatively or additionally contain nonionic fabric softening agents such as lanolin and derivatives thereof.

Lecithins and other phospholipids are also suitable softening compounds.

In fabric softening compositions nonionic stabilising agent may be present. Suitable nonionic stabilising agents may be present such as linear $C_8$ to $C_{22}$ alcohols alkoxylated with 10 to 20 moles of alkylene oxide, $C_{10}$ to $C_{20}$ alcohols, or mixtures thereof. Other stabilising agents include the deflocculating polymers as described in EP 0415698A2 and EP 0458599 B1.

Advantageously the nonionic stabilising agent is a linear $C_8$ to $C_{22}$ alcohol alkoxylated with 10 to 20 moles of alkylene oxide. Preferably, the level of nonionic stabiliser is within the range from 0.1 to 10% by weight, more preferably from 0.5 to 5% by weight, most preferably from 1 to 4% by weight. The mole ratio of the quaternary ammonium compound and/or other cationic softening agent to the nonionic stabilising agent is suitably within the range from 40:1 to about 1:1, preferably within the range from 18:1 to about 3:1.

The composition can also contain fatty acids, for example $C_8$ to $C_{24}$ alkyl or alkenyl monocarboxylic acids or polymers thereof. Preferably saturated fatty acids are used, in particular, hardened tallow $C_{16}$ to $C_{18}$ fatty acids. Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated compositions may comprise from 0.5 to 20% by weight of fatty acid, more preferably 1% to 10% by weight. The weight ratio of quaternary ammonium material or other cationic softening agent to fatty acid material is preferably from 10:1 to 1:10.

It is also possible to include certain mono-alkyl cationic surfactants which can be used in main-wash compositions for fabrics. Cationic surfactants that may be used include quaternary ammonium salts of the general formula $R^1R_2R_3R_4N^+X^-$ wherein the R groups are long or short hydrocarbon chains, typically alkyl, hydroxyalkyl or ethoxylated alkyl groups, and X is a counter-ion (for example, compounds in which $R_1$ is a $C_8$-$C_{22}$ alkyl group, preferably a $C_8$-$C_{10}$ or $C_{12}$-$C_{14}$ alkyl group, $R_2$ is a methyl group, and $R_3$ and $R_4$, which may be the same or different, are methyl or hydroxyethyl groups); and cationic esters (for example, choline esters).

The choice of surface-active compound (surfactant), and the amount present, will depend on the intended use of the detergent composition. In fabric washing compositions, different surfactant systems may be chosen, as is well known to the skilled formulator, for handwashing products and for products intended for use in different types of washing machine.

The total amount of surfactant present will also depend on the intended end use and may be as high as 60 wt %, for example, in a composition for washing fabrics by hand. In compositions for machine washing of fabrics, an amount of from 5 to 40 wt % is generally appropriate. Typically the compositions will comprise at least 2 wt % surfactant e.g. 2-60%, preferably 15-40% most preferably 25-35%.

Detergent compositions suitable for use in most automatic fabric washing machines generally contain anionic non-soap surfactant, or non-ionic surfactant, or combinations of the two in any suitable ratio, optionally together with soap.

Other Ingredients

The compositions of the invention, when used as main wash fabric washing compositions, will generally also contain one or more perfume. Perfumes, especially those used in laundry treatment products consist of at least one but usually, a mixture of a plurality of fragrances of natural and/or synthetic origin dispersed, or more usually dissolved in a vehicle or carrier. The vehicle or carrier may be aqueous (i.e. water or water plus one or more water-miscible solvents) or it may consist solely of one or more organic solvents which may or may not be water-miscible, even though water is substantially absent. This is in addition to and separate from any perfume that is used as the viscosity modifying agent as described above.

The compositions of the invention, when used as main wash fabric washing compositions, will generally also contain one or more detergency builders. The total amount of detergency builder in the compositions will typically range from 5 to 80 wt %, preferably from 10 to 60 wt %.

Inorganic builders that may be present include sodium carbonate, if desired in combination with a crystallisation seed for calcium carbonate, as disclosed in GB 1 437 950 (Unilever); crystalline and amorphous aluminosilicates, for example, zeolites as disclosed in GB 1 473 201 (Henkel), amorphous aluminosilicates as disclosed in GB 1 473 202 (Henkel) and mixed crystalline/amorphous aluminosilicates as disclosed in GB 1 470 250 (Procter & Gamble); and layered silicates as disclosed in EP 164 514B (Hoechst). Inorganic phosphate builders, for example, sodium orthophosphate, pyrophosphate and tripolyphosphate are also suitable for use with this invention.

The compositions of the invention preferably contain an alkali metal, preferably sodium, aluminosilicate builder. Sodium aluminosilicates may generally be incorporated in amounts of from 10 to 70% by weight (anhydrous basis), preferably from 25 to 50 wt %.

The alkali metal aluminosilicate may be either crystalline or amorphous or mixtures thereof, having the general formula: 0.8-1.5 $Na_2O.Al_2O_3$.0.8-6 $SiO_2$ These materials contain some bound water and are required to have a calcium ion exchange capacity of at least 50 mg CaO/g. The preferred sodium aluminosilicates contain 1.5-3.5 $SiO_2$ units (in the formula above). Both the amorphous and the crystalline materials can be prepared readily by reaction between sodium silicate and sodium aluminate, as amply described in the literature. Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP 384 070A (Unilever). Zeolite MAP is defined as an alkali metal aluminosilicate of the zeolite P type having a silicon to aluminium weight ratio not exceeding 1.33, preferably within the range of from 0.90 to 1.33, and more preferably within the range of from 0.90 to 1.20.

Especially preferred is zeolite MAP having a silicon to aluminium weight ratio not exceeding 1.07, more preferably about 1.00. The calcium binding capacity of zeolite MAP is generally at least 150 mg CaO per g of anhydrous material.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di and trisuccinates, carboxymethyloxy succinates, carboxymethyloxymalonates, dipicolinates, hydroxyethyliminodiacetates, alkyl- and alkenylmalonates and succinates; and sulphonated fatty acid salts. This list is not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Compositions according to the invention may also suitably contain a bleach system. Fabric washing compositions may desirably contain peroxy bleach compounds, for example, inorganic persalts or organic peroxyacids, capable of yielding hydrogen peroxide in aqueous solution.

Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate.

Especially preferred is sodium percarbonate having a protective coating against destabilisation by moisture. Sodium percarbonate having a protective coating comprising sodium metaborate and sodium silicate is disclosed in GB 2 123 044B (Kao).

The peroxy bleach compound is suitably present in an amount of from 0.1 to 35 wt %, preferably from 0.5 to 25 wt %. The peroxy bleach compound may be used in conjunction with a bleach activator (bleach precursor) to improve bleaching action at low wash temperatures. The bleach precursor is suitably present in an amount of from 0.1 to 8 wt %, preferably from 0.5 to 5 wt %.

Preferred bleach precursors are peroxycarboxylic acid precursors, more especially peracetic acid precursors and pernoanoic acid precursors. Especially preferred bleach precursors suitable for use in the present invention are N,N,N',N',-tetracetyl ethylenediamine (TAED) and sodium nonanoyloxybenzene sulphonate (SNOBS). The novel quaternary ammonium and phosphonium bleach precursors disclosed in U.S. Pat. No. 4,751,015 and U.S. Pat. No. 4,818,426 (Lever Brothers Company) and EP 402 971A (Unilever), and the cationic bleach precursors disclosed in EP 284 292A and EP 303 520A (Kao) are also of interest.

The bleach system can be either supplemented with or replaced by a peroxyacid examples of such peracids can be found in U.S. Pat. No. 4,686,063 and U.S. Pat. No. 5,397,501 (Unilever). A preferred example is the imido peroxycarboxylic class of peracids described in EP A 325 288, EP A 349 940, DE 382 3172 and EP 325 289. A particularly preferred example is phthalimido peroxy caproic acid (PAP). Such peracids are suitably present at 0.1-12%, preferably 0.5-10%.

A bleach stabiliser (transition metal sequestrant) may also be present. Suitable bleach stabilisers include ethylenediamine tetra-acetate (EDTA), the polyphosphonates such as Dequest (Trade Mark) and non-phosphate stabilisers such as EDDS (ethylene diamine di-succinic acid). These bleach stabilisers are also useful for stain removal especially in products containing low levels of bleaching species or no bleaching species.

An especially preferred bleach system comprises a peroxy bleach compound (preferably sodium percarbonate optionally together with a bleach activator), and a transition metal bleach catalyst as described and claimed in EP 458 397A ,EP 458 398A and EP 509 787A (Unilever).

The compositions according to the invention may also contain one or more enzyme(s). Suitable enzymes include the proteases, amylases, cellulases, oxidases, peroxidases and lipases usable for incorporation in detergent compositions. Preferred proteolytic enzymes (proteases) are, catalytically active protein materials which degrade or alter protein types of stains when present as in fabric stains in a hydrolysis reaction. They may be of any suitable origin, such as vegetable, animal, bacterial or yeast origin.

Proteolytic enzymes or proteases of various qualities and origins and having activity in various pH ranges of from 4-12 are available and can be used in the instant invention. Examples of suitable proteolytic enzymes are the subtilisins which are obtained from particular strains of *B. Subtilis B. licheniformis,* such as the commercially available subtilisins Maxatase (Trade Mark), as supplied by Genencor International N.V., Delft, Holland, and Alcalase (Trade Mark), as supplied by Novozymes Industri A/S, Copenhagen, Denmark.

Particularly suitable is a protease obtained from a strain of Bacillus having maximum activity throughout the pH range of 8-12, being commercially available, e.g. from Novozymes Industri A/S under the registered trade-names Esperase (Trade Mark) and Savinase (Trade-Mark). The preparation of these and analogous enzymes is described in GB 1 243 785. Other commercial proteases are Kazusase (Trade Mark obtainable from Showa-Denko of Japan), Optimase (Trade Mark from Miles Kali-Chemie, Hannover, West Germany), and Superase (Trade Mark obtainable from Pfizer of U.S.A.).

Detergency enzymes are commonly employed in granular form in amounts of from about 0.1 to about 3.0 wt %. However, any suitable physical form of enzyme may be used.

The compositions of the invention may contain alkali metal, preferably sodium carbonate, in order to increase detergency and ease processing. Sodium carbonate may suitably be present in amounts ranging from 1 to 60 wt %, preferably from 2 to 40 wt %. However, compositions containing little or no sodium carbonate are also within the scope of the invention.

Powder flow may be improved by the incorporation of a small amount of a powder structurant, for example, a fatty acid (or fatty acid soap), a sugar, an acrylate or acrylate/maleate copolymer, or sodium silicate. One preferred powder structurant is fatty acid soap, suitably present in an amount of from 1 to 5 wt %.

Other materials that may be present in detergent compositions of the invention include sodium silicate; antiredeposition agents such as cellulosic polymers; soil release polymers; inorganic salts such as sodium sulphate; or lather boosters as appropriate; proteolytic and lipolytic enzymes; dyes; coloured speckles; fluorescers and decoupling polymers. This list is not intended to be exhaustive. However, many of these ingredients will be better delivered as benefit agent groups in materials according to the first aspect of the invention.

The detergent composition when diluted in the wash liquor (during a typical wash cycle) will typically give a pH of the wash liquor from 7 to 10.5 for a main wash detergent.

Particulate detergent compositions are suitably prepared by spray-drying a slurry of compatible heat-insensitive ingredients, and then spraying on or post-dosing those ingredients unsuitable for processing via the slurry. The skilled detergent formulator will have no difficulty in deciding which ingredients should be included in the slurry and which should not.

Particulate detergent compositions of the invention preferably have a bulk density of at least 400 g/l, more preferably at least 500 g/l. Especially preferred compositions have bulk densities of at least 650 g/litre, more preferably at least 700 g/litre.

Such powders may be prepared either by post-tower densification of spray-dried powder, or by wholly non-tower methods such as dry mixing and granulation; in both cases a high-speed mixer/granulator may advantageously be used. Processes using high-speed mixer/granulators are disclosed, for example, in EP 340 013A, EP 367 339A, EP 390 251A and EP 420 317A (Unilever).

Liquid detergent compositions can be prepared by admixing the essential and optional ingredients thereof in any desired order to provide compositions containing components in the requisite concentrations. Liquid compositions according to the present invention can also be in compact form which means it will contain a lower level of water compared to a conventional liquid detergent.

Product Forms

Product forms include powders, liquids, gels, tablets, any of which are optionally incorporated in a water-soluble or water dispersible sachet. The means for manufacturing any of the product forms are well known in the art. If the silicone and the substituted polysaccharide are to be incorporated in a powder (optionally the powder to be tableted), and whether or not pre-emulsified, they are optionally included in a separate granular component, e.g. also containing a water soluble organic or inorganic material, or in encapsulated form.

Substrate

The substrate may be any substrate onto which it is desirable to deposit silicones thereto, and which is subjected to treatment such as a washing or rinsing process.

In particular, the substrate may be a textile fabric. It has been found that particular good results are achieved when using a natural fabric substrate such as cotton, or fabric blends containing cotton.

Treatment

The treatment of the substrate with the material of the invention can be made by any suitable method such as washing, soaking or rinsing of the substrate.

Typically the treatment will involve a washing or rinsing method such as treatment in the main wash or rinse cycle of a washing machine and involves contacting the substrate with an aqueous medium comprising the material of the invention.

Preferably the treatment will involve a process for laundering fabrics by machine or hand, which includes the step of immersing the fabrics in a wash liquor comprising water in which a laundry treatment composition according to the invention is dissolved or dispersed. Preferably, the fabrics comprise cotton fabrics.

EXAMPLES

The present invention will now be explained in more detail by reference to the following non-limiting examples:

In the following examples where percentages are mentioned, this is to be understood as percentage by weight. In the following tables where the values do not add up to 100 these are to be understood as parts by weight.

Sample Synthesis of a Deposition Aid—an Ester Linked Cellulose Monoacetate (CMA) with Grafted Silicone Monocarboxydecyl terminated polydimethylsiloxane (PDMS) source (Mwt 5,000: 1.5 g, 0.23 mmols) was dispersed in dimethylacetamide (10 $cm^3$) by vigorous stirring under nitrogen. Carbonyldiimidazole (37 mg, 0.23 mmols) was then added and the dispersion heated with stirring to 70° C. under nitrogen for two hours. A solution of cellulose monoacetate (DS 0.58; 1 g, 5.3 mmol equivalents based on primary hydroxyl groups) in dimethylacetamide (10 $cm^3$) was then added and stirring and heating was continued for a further 20 hours. Following this time the mixture was filtered and the filtrate added to vigorously stirring acetone to give a white precipitate. This precipitate was filtered off, washed with acetone and dried under vacuum to give a white polymer (1.01 g). From the $^1H$ NMR of the polymer (after hydrolysis of 20% DCl in $D_2O$ for two hours at 80° C.) and normalising the integration of the anomeric protons to unity and the acetate group to 0.58 the Si—$CH_3$ group (at 0.0 ppm) integration gives an overall degree of substitution (DS) of siloxane groups of 0.0015 (hereinafter referred to as "Polymer A").

Addition of Compositions of the Invention

A commercially available viscous silicone ex Rhodia (Extrasoft, Trademark) was mixed with a viscosity modifier as detailed in Examples 1 to 12 below, using a bottle roller. It was then emulsified with Polymer A using a nonionic surfactant (Synperonic A7, ex Shell). For instance, an emulsion containing 10% by weight of viscosity modifier had the following composition:

| Ingredient | Quantity |
|---|---|
| Viscous silicone | 0.9 g |
| Viscosity modifier | 0.1 g |
| Polymer A | 0.1 g |
| Synperonic A7 | 0.03 g |
| Demineralised water | 100 ml |

Other emulsions were made by varying the quantities of viscous silicone and viscosity modifier so that the total quantity of viscous silicone and viscosity modifier always added up to 1 g. For instance, an emulsion containing 20% viscosity modifier would contain 0.2 g viscosity modifier and 0.8 g viscous silicone. The quantities of the remaining three ingredients were not varied. The emulsion was added to the wash liquor with stirring, in an amount such that a viscous silicone concentration equivalent to 3 mg/g cotton was achieved.

Wash Liquor

Two types of wash liquor (L1 and L2) were used in the following examples. The compositions are given in the following tables:

TABLE 1

| Ingredient | Quantity (wt %) L1 |
|---|---|
| Wash Liquor | |
| surfactant - Linear Alkyl Sulphonate:A7 in a ratio of 50:50 (w/w) | 20 |
| buffer - 0.08 M sodium carbonate ($Na_2CO_3$) & 0.02 M sodium hydrogen carbonate ($NaHCO_3$) | 10 |
| demineralised water | 70 |
| pH | 10.5 |

TABLE 2

| Ingredient | Quantity (wt %) L2 |
|---|---|
| Na-LAS 100% | 5.06 |
| Nonionic 7EO | 3.94 |
| Zeolite MAP (anhydrous basis) | 12.25 |
| Na-carbonate light | 5.37 |
| Soap | 0.57 |
| SCMC (69%) | 0.23 |
| Moisture, salts, etc | 2.58 |
| demineralised water | 70 |

Protocol for Washing Test Cloths (Silicone Deposition)

The following protocol was used in the following examples to deposit silicone onto test cloths from the wash.

The test cloths used were mercerised cotton, 20 cm×20 cm in size.

The cloths were washed in 200 ml pots, which were prepared as follows:

Per pot 0.1 litre of wash liquor (as detailed in the table above, which included enough test composition to give 3.0 mg silicone per g of cotton)

1 cotton test cloth

Each pot was then heated to 40° C. for 30 min with agitation (bottleshaker at a shake speed of about 100 shakes per minute). The cloths were then rinsed in 2×200 ml tap water (nominal hardness 24° F. H) and dried overnight on a flat surface at ambient temperature.

Protocol for Measuring Silicone Eeposition

The dried fabrics were then analysed for silicone deposition according to the following protocol:

Solvent extraction of silicone from fabric was carried out using 10 ml Tetrahydrofuran (THF) per g of cotton.

The silicone was then extracted at room temperature for 24 h under constant agitation.

The THF was then analysed for silicone levels via gel permeation chromatography (GPC), using an evaporative light scattering detector.

An analogous method was used to detect perfume deposition.

Examples 1 to 6 and Comparative Example A

Preparation of Laundry Compositions—Volatile Silicone as Viscosity Modifier for Viscous Silicone A commercially available viscous silicone ex Rhodia (Extrasoft, Trademark) was mixed with a commercially available volatile silicone ex Dow Corning (DC245) in a bottle on a bottle roller. The viscosity of the resulting mixture was then measured.

Examples 1 to 6 (i.e. compositions according to the invention) and Comparative example A (not according to the invention) were prepared according to Table 3 below. Viscosities are also shown.

TABLE 3

| | Amount (wt %) | | |
|---|---|---|---|
| Example | viscous silicone | volatile silicone | *Viscosity (mPas) |
| A | 100 | 0 | 6,127 |
| 1 | 95 | 5 | 4,950 |
| 2 | 90 | 10 | 4,176 |

TABLE 3-continued

| Example | Amount (wt %) viscous silicone | volatile silicone | *Viscosity (mPas) |
|---|---|---|---|
| 3 | 80 | 20 | 2,726 |
| 4 | 66 | 34 | 1,181 |
| 5 | 50 | 50 | 502 |
| 6 | 34 | 66 | 223 |

*Viscosity as measured with a Bohlin CVO120 rheometer using a cone and plate method at a shear rate of 100 $s^{-1}$ at 22° C.

Evaluation of Silicone Deposition Using Examples 2, 3, 5, 6 and Comparative Example A Cotton cloths was washed according to the protocol given above using Examples 2, 3, 5 and 6 and Comparative Example A, and the deposition of viscous silicone was then determined from wash liquor L1 according to the method given above. The results expressed in mg of viscous silicone deposited per g of cotton are given in Table 4 below.

TABLE 4

| Example | viscous silicone deposition (mg/g) |
|---|---|
| A | 0.506 |
| 2 | 0.797 |
| 3 | 0.869 |
| 5 | 0.861 |
| 6 | 0.852 |

It will be seen that doping the viscous silicone with volatile silicone (DC245), according to the invention, increases the level of deposition of viscous silicone onto the fabric.

Evaluation of Silicone Deposition Using Examples 1 and 2 and Comparative Example A In a separate experiment, cotton was washed in L1 and L2 as described above (note: due to the nature of the experiments, results are only comparable within a single set of experiments and not between separate sets).

Deposition of viscous silicone is given in Table 5 below.

TABLE 5

| Example | Deposition form L1 viscous silicone deposition (mg/g) L1 | L2 |
|---|---|---|
| A | 0.37 | 0.41 |
| 1 | 0.59 | 0.48 |
| 2 | 0.53 | 0.53 |

It will be seen that deposition of viscous silicone from compositions according to the invention is enhanced.

Examples 7 and 8

Preparation of Laundry Compositions—Perfume as Viscosity Modifier

Viscous silicone was combined with perfume (Geraniol, ex Firmenich, Trademark) in a ratio (w/w) of 90:10. Deposition of viscous silicone onto cotton sheeting was then measured as described above, using wash liquor L1. The effect of ageing under ambient conditions was also studied.

Examples 7 and 8 (i.e. compositions according to the invention) were prepared according to Table 6 below.

TABLE 6

| Example | Amount (wt %) Viscous silicone | Perfume | Ageing time |
|---|---|---|---|
| 7 | 90 | 10 | 0 |
| 8 | 90 | 10 | 24 h |

Evaluation of Silicone Deposition Using Examples 7 & 8 and Comparative Examples A & B Cotton fabric was washed according to the protocol given above using Examples 7, and 8 and Comparative Example A and the deposition of viscous silicone from wash liquor L1 was then determined according to the method given above. The results expressed in mg of silicone deposited per g of cotton are given in Table 7 below.

TABLE 7

| Example | silicone deposition (mg/g) |
|---|---|
| A | 0.243 |
| 7 | 0.385 |
| 8 | 0.509 |

It will be seen that doping the viscous silicone with perfume, according to the invention, enhances the level of viscous silicone deposition onto the fabric.

Examples 10 and 11

Preparation of Laundry Compositions—Organic Solvents as Viscosity Modifiers

Viscous silicone was combined with organic solvents (Isopropyl alcohol or hexane) in a ratio (w/w) of 90:10.

TABLE 9

| Example | Amount (wt %) Viscous silicone | Solvent |
|---|---|---|
| 10 | 90 | 10 Isopropyl alcohol (IPA) |
| 11 | 90 | 10 Hexane |

Evaluation of Silicone Deposition Using Examples 10 & 11 and Comparative Example A Cotton fabric was washed according to the protocol given above using Examples 10, and 11 (i.e. compositions according to the invention) and Comparative Example A (not according to the invention) and the deposition of viscous silicone onto cotton sheeting from wash liquor L2 was then determined according to the method given above. The results are given in Table 10 below.

TABLE 10

| Example | silicone deposition (mg/g) |
|---|---|
| A | 0.256 |
| 10 | 0.286 |
| 11 | 0.341 |

It will be seen that doping the viscous silicone with organic solvent (IPA or hexane), according to the invention, enhanced the level of viscous silicone deposition onto the fabric.

Example 12

Preparation of Laundry Compositions—Low Viscosity Silicone as Viscosity Modifier Viscous silicone was combined with a low viscosity silicone (Hydrosoft, an amino silicone, ex Rhodia).

TABLE 11

| | Amount (wt %) | |
|---|---|---|
| Example | Viscous silicone | Hydrosoft |
| 12 | 90 | 10 |

Evaluation of Silicone Deposition Using Example 12 and Comparative Example A

Cotton fabric was washed according to the protocol given above using Examples 7, and 8 (i.e. compositions according to the invention) and Comparative Examples A and B (not according to the invention) and the deposition of viscous silicone onto cotton sheeting from wash liquor L2 was then determined according to the method given above. The results are given in Table 12 below.

TABLE 12

| Example | silicone deposition (mg/g) |
|---|---|
| A | 0.256 |
| 12 | 0.325 |

It will be seen that doping the viscous silicone with low viscosity silicone (Hydrosoft), according to the invention, enhances the level of viscous silicone deposition onto the fabric.

The invention claimed is:

1. A laundry treatment composition comprising a silicone having a viscosity above 5,000 mPas, and having a viscosity modifying agent selected from the group consisting of a volatile silicone, a perfume, an organic solvent and a low viscosity silicone, which is soluble in the silicone, and is dissolved in the silicone and a deposition aid wherein the deposition aid is a beta 1-4 linked substituted polysaccharide having a number average molecular weight in the range of 1,000 to 200,000, comprising one or more moieties for enhancing affinity for a fabric, and one or more silicone moieties, wherein the silicone with dissolved viscosity modifying agent and the deposition aid is in the form of an emulsion, and wherein the amount of viscosity modifying agent is from 5% to 40% by weight of the silicone.

2. A laundry treatment composition as claimed in claim 1, wherein the viscosity modifying agent(s) are a volatile silicone, a perfume or a blend thereof.

3. A laundry treatment composition as claimed in claim 2, wherein the perfume which comprises the viscosity modifying agent, also comprises a vehicle or carrier therefor, at least part of the vehicle or carrier also being dissolved or dispersed in the silicone, the weight ratio of all dispersed and dissolved parts of perfume to the silicone being from 1:1,000 to 2:1.

4. A laundry treatment composition as claimed claim 1, wherein the ratio of total dissolved viscosity modifying agent to silicone is from 1:10,000 to 1:5.

5. A laundry treatment composition according to claim 1, wherein the composition is in the form of an emulsion and further comprises an emulsifying agent.

6. An emulsion according to claim 5, wherein the emulsifying agent comprises a nonionic surfactant.

7. An emulsion according to claim 5, wherein the total amount of silicone with dissolved viscosity modifying agent is from 50 to 95% by weight of the silicone with dissolved or dispersed viscosity modifying agent plus deposition aid plus any emulsifying agent.

8. An emulsion according to claim 5, wherein the emulsion comprises from 30% to 99.9% of another liquid component.

9. A laundry treatment composition according to claim 5, wherein the weight ratio of silicone with dissolved viscosity modifying agent to emulsifying agent is from 100:1 to 2:1.

10. A laundry treatment composition as claimed in claim 1, wherein the weight ratio of silicone with dissolved viscosity modifying agent to the deposition aid is from 1:1 to 100:1.

11. A laundry treatment composition as claimed in claim 1, wherein the deposition aid has covalently bonded on the polysaccharide moiety thereof, at least one deposition enhancing group which undergoes a chemical change in water at a use temperature to increase the affinity of the substituted polysaccharide to a substrate, the substituted polysaccharide further comprising one or more independently selected silicone chains.

12. A laundry treatment composition as claimed in claim 11, wherein the average degree of substitution of the silicone chain(s) on the substituted polysaccharide is from 0.001 to 0.5.

13. A laundry treatment composition as claimed in claim 11, wherein the silicone chain(s) in the substituted polysaccharide is or are independently selected from those of formula:

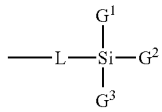

wherein L is absent or is a linking group and one or two of substituents $G^1$-$G^3$ is a methyl group, the remainder being selected from groups of formula

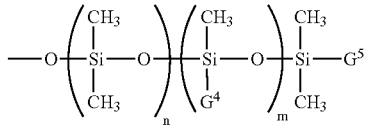

the $—Si(CH_3)_2O—$ groups and the $—Si(CH_3O)(G^4)—$ groups being arranged in random or block fashion wherein n is from 5 to 1000 and m is from 0 to 100

$G^4$ is selected from groups of formula:

—$(CH_2)_p$—$CH_3$, where p is from 1 to 18

—$(CH_2)_c$—NH—$(CH_2)_n$—$NH_2$ where q and r are independently from 1 to 3

—$(CH_2)_s$—$NH_2$, where s is from 1 to 3

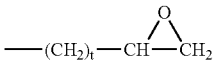

where t is from 1 to 3

—$(CH_2)_u$—COOH, where u is from is from 1 to 10,

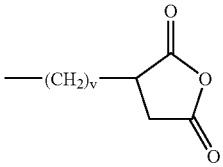

where v is from 1 to 10, and

—$(CH_2CH_2O)_w$—$(CH_2)_xH$, where w is from 1 to 150, and x is from 0 to 10;

and $G^5$ is independently selected from hydrogen, groups defined abobve for $G^4$, —OH, —$CH_3$ and —$C(CH_3)_3$.

14. A laundry treatment composition as claimed in claim 13, where L is selected from amide linkages, ester linkages, ether linkages, urethane linkages, triazine linkages, carbonate linkages, amine linkages and ester-alkylene linkages.

15. A laundry treatment composition as claimed in claim 11, wherein the chemical change of the relevant group in the substituted polysaccharide is hydrolysis, perhydrolysis or bond-cleavage, optionally catalysed by an enzyme or another catalyst.

16. A laundry treatment composition as claimed in claim 11, wherein the group(s) in the substituted polysaccharide deposition aid which undergo the chemical change comprise one or more groups attached via an ester linkage to the polysaccharide.

17. A laundry treatment composition as claimed in claim 11 wherein the substituted polysaccharide has the general formula (I):

(I)

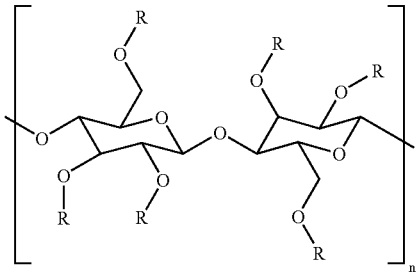

(optional $\beta_{1-3}$ and/or other linkages and/or other groups being permitted in the formula (I)) wherein at least one or more —OR groups of the polymer are independently substituted or replaced by silicone chains and at least one or more R groups are independently selected from groups of formulae:

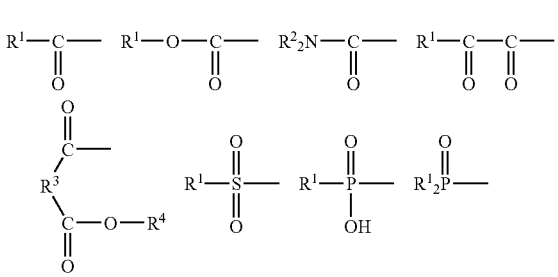

wherein each $R^1$ is independently selected from $(C_{1-20})$ alkyl, $(C_{2-20})$ alkenyl and $(C_{5-7}$ aryl) any of which is optionally substituted by one or more substituents independently selected from $C_{1-4}$ alkyl, $(C_{1-12})$ alkoxy, hydroxyl, vinyl and phenyl groups;

each $R^2$ is independently selected from hydrogen and groups $R^1$ as hereinbefore defined;

$R^3$ is a bond or is selected from $C_{1-4}$ alkylene, $C_{2-4}$ alkenylene and $C_{5-7}$ arylene groups, the carbon atoms in any of these being optionally substituted by one or more substituents independently selected from $C_{1-2}$ alkoxy, vinyl, hydroxyl, halo and amine groups;

each $R^4$ is independently selected from hydrogen, counter cations such as alkali metal or/1;2 Ca or/1;2 Mg, and groups $R^1$ as hereinbefore defined; and groups R which together with the oxygen atom forming the linkage to the respective saccharide ring forms an ester or hemi-ester group of a tricarboxylic- or higher polycarboxylic- or other complex acid, an amino acid, a synthetic amino acid analogue or a protein;

any remaining R groups being selected from hydrogen and other substituents.

18. A laundry treatment composition as claimed in claim 16, wherein the ester-linked group(s) is/are selected from carboxylic acid esters.

19. A laundry treatment composition as claimed in claim 16, wherein the ester-linked group(s) is/are independently selected from the group consisting of one or more of acetate, propanoate, trifluroacetate, 2-(2-hydroxy-1-oxopropoxy) propanoate, lactate, glycolate, pyruvate, crotonate, isovalerate, cinnamate, formate, salicylate, carbamate, methylcarbamate, benzoate, gluconate, methanesulphonate, toluene sulphonate, groups and hemiester groups of fumaric, malonic, itaconic, oxalic, maleic, succinic, tartaric, aspartic, glutamic, and malic acids.

20. A laundry treatment composition as claimed in claim 11, wherein the average degree of substitution on the saccharide rings of the polysaccharide, of the groups which undergo the chemical change is from 0.1 to 3.

21. A laundry treatment composition as claimed in claim 11, wherein the substituted polysaccharide further comprises one or more other pendant groups which are neither silicone chains nor groups which undergo a chemical change to enhance substrate affinity.

22. A laundry treatment composition as claimed in claim 21, wherein the average degree of substitution of other pendant groups is from 0.001 to 0.5.

23. A laundry treatment composition as claimed in claim 11, wherein the total amount of the substituted polysaccharide is from 0.001% to 10% by weight of the total composition.

24. A laundry treatment composition as claimed in claim 1, wherein the total amount of silicone with dissolved viscosity modifying agent is from 0.0001% to 25% by weight of the total composition.

25. A laundry treatment composition as claimed in claim 1, wherein at least the silicone with dissolved viscosity modifying agent and the deposition aid is in an amount of from 0.0001 to 40% by weight of the total composition.

26. A laundry treatment composition as claimed in claim 1, which is a main wash composition.

27. A laundry treatment composition as claimed in claim 26, which further comprises:

(a) from 5 to 60 wt % of organic surfactant, (b) optionally from 5 to 80 wt % of detergency builder, and (c) optionally other detergent ingredients to 100 wt %.

28. A method for depositing a silicone onto a substrate, comprising contacting in an aqueous medium, the substrate and a composition according to claim 1.

29. A process for laundering fabrics by machine or hand, which includes the step of immersing the fabrics in a wash liquor comprising water in which a laundry treatment composition as claimed in claim 1 is dissolved or dispersed.

30. A process as claimed in claim 29, wherein fabrics comprise cotton fabrics.

31. A method for treating fabrics during a laundry process to enhance the softening benefit of a laundry treatment composition on a substrate, comprising the step of treating the fabrics with a laundry treatment composition as claimed in claim 1.

32. The composition of claim 3, wherein the weight ratio of all dissolved parts of perfume to the silicone being from 1:100 to 1:15.

33. The composition of claim 3, wherein the weight ratio of all dissolved parts of perfume to the silicone being from 1:50 to 1:10.

34. The composition of claim 4 wherein the ratio of total dissolved viscosity modifying agent to silicone is from 1:1,000 to 1:10.

35. The composition of claim 7 wherein the total amount of silicone with dissolved viscosity modifying agent is from 60 to 90%.

36. The composition of claim 7 wherein the total amount of silicone with dissolved viscosity modifying agent is from 70 to 85%.

37. The composition of claim 8 wherein the emulsion comprises 40 to 99% of another liquid component.

38. The composition of claim 8 wherein the emulsion comprises a polar solvent.

39. The composition of claim 38 wherein the polar solvent is water.

40. The composition of claim 9 wherein the weight ratio of silicone with dissolved viscosity modifying agent to emulsifying agent is from 100:3 to 5:1.

41. The composition of claim 9 wherein the weight ratio of silicone with dissolved viscosity modifying agent to emulsifying agent is from 15:1 to 7:1.

42. The composition of claim 10 wherein the weight ratio of silicone with dissolved viscosity modifying agent to the deposition aid is from 5:1 to 20:1.

43. The composition of claim 12 wherein the average degree of substitution of the silicone chain(s) on the substituted polysaccharide is from 0.01 to 0.5.

44. The composition of claim 12 wherein the average degree of substitution of the silicone chain(s) on the substituted polysaccharide is from 0,01 to 0.1.

45. The composition of claim 12 wherein the average degree of substitution of the silicone chain(s) on the substituted polysaccharide is from 0.01 to 0.05.

46. The composition of claim 13 wherein the —$Si(GH_3)_2O$— groups and the —$Si(CH_3O)(G^4)$- groups are arranged in random fashion.

47. The composition of claim 20 wherein the average degree of substitution on the saccharide rings of the polysaccharide, of the groups which undergo the chemical change is from 0.1 to 1.

48. The composition of claim 22 wherein the average degree of substitution of other pendant groups is from 0.001 to 0.5.

49. The composition of claim 23 wherein the total amount of the substituted polysaccharide is from 0.005 to 5% by weight of the total composition.

50. The composition of claim 23 wherein the total amount of the substituted polysaccharide is from 0.01 to 3% by weight of the total composition.

51. The composition of claim 24 wherein the total amount of silicone with dissolved or dispersed viscosity modifying agent is from 0.0001 to 5% by weight of the total composition.

52. The composition of claim 25 wherein at least the silicone with dissolved viscosity modifying agent and the deposition aid is in an amount of from 0.1 to 20% by weight of the total composition.

* * * * *